United States Patent [19]

Hirabayashi et al.

[11] Patent Number: 4,894,322

[45] **Date of Patent: * Jan. 16, 1990**

[54] LIGHT-SENSITIVE SILVER HALIDE COLOR PHOTOGRAPHIC MATERIAL

[75] Inventors: Shigeto Hirabayashi; Syoji Matsuzaka; Yukio Ohya; Yoshiyuki Nonaka, all of Hino, Japan

[73] Assignee: Konica Corporation, Tokyo, Japan

[ * ] Notice: The portion of the term of this patent subsequent to Dec. 1, 2004 has been disclaimed.

[21] Appl. No.: 831,993

[22] Filed: Feb. 20, 1986

[30] Foreign Application Priority Data

Feb. 27, 1985 [JP] Japan ..... 60-36278

[51] Int. Cl.[4] ..... G03C 7/38; G03C 1/02

[52] U.S. Cl. ..... 430/505; 430/387; 430/558; 430/567

[58] Field of Search ..... 430/505, 558, 567, 386, 430/387

[56] References Cited

U.S. PATENT DOCUMENTS

| | | | |
|---|---|---|---|
| 4,548,899 | 10/1985 | Nakayama et al. | 430/558 |
| 4,562,146 | 12/1985 | Masuda et al. | 430/546 |
| 4,576,910 | 3/1986 | Hirano et al. | 430/548 |
| 4,590,153 | 5/1986 | Kawagishi et al. | 430/558 |
| 4,607,002 | 8/1986 | Nakayama et al. | 430/505 |
| 4,623,617 | 11/1986 | Kaneko et al. | 430/551 |
| 4,639,413 | 1/1987 | Kawagishi et al. | 430/505 |
| 4,665,015 | 5/1987 | Iijima et al. | 430/558 |
| 4,675,280 | 6/1987 | Kaneko et al. | 430/558 |
| 4,710,453 | 12/1987 | Hirabayashi et al. | 430/505 |

FOREIGN PATENT DOCUMENTS

| | | |
|---|---|---|
| 0192471 | 2/1986 | European Pat. Off. . |
| 1810464 | 11/1967 | Fed. Rep. of Germany . |
| 202063 | of 1984 | Japan . |
| 038944 | 2/1986 | Japan . |
| 1247493 | 11/1967 | United Kingdom . |
| 1252418 | 11/1967 | United Kingdom . |
| 2135788 | 1/1984 | United Kingdom . |

OTHER PUBLICATIONS

Patent Abstracts of Japan, vol. 10, No. 195 (P-475)[2251], Jul. 9, 1986.

*Primary Examiner*—Paul R. Michl
*Assistant Examiner*—Lee C. Wright
*Attorney, Agent, or Firm*—Frishauf, Holtz, Goodman & Woodward

[57] ABSTRACT

A light-sensitive silver halide color photographic material having photographic constituent layers including a blue-sensitive silver halide emulsion layer, a green-sensitive silver halide emulsion layer and a red-sensitive silver halide emulsion layer on a support, wherein the content of silver bromide of the silver halides in the green-sensitive silver halide emulsion layer and red-sensitive silver halide emulsion layer is 5 to 65 mole %, and the green-sensitive silver halide emulsion layer contains at least one of the compounds represented by the formula shown below:

wherein X represents a halogen atom or a monovalent organic group eliminable through coupling reaction with an oxidized product of a developing agent; $R_1$ to $R_3$, which may be either identical or different, each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residue, a bridged hydrocarbon compound residue, an alkoxy group, an aryloxy group, a heterocycloxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarboynyl group, an alkylthio group, an arylthio group or a heterocyclic thio group, with proviso that at least two of $R_1$ to $R_3$ are not hydrogen atoms; $R_4$ represents a hydrogen atom, an alkyl group, an aryl group, a heterocyclic group, an acylamino group, an alkylamino group, an anilino group, an alkoxycarbonyl group or an alkylthio group.

According to the light-sensitive silver halide color photographic material of this invention, rapid developing processing is possible with improvement of processing stability in the rapid developing processing, and yet saving of silver is possible, simultaneously with inhibition of generation of fog, and moreover color image with good light resistance can be obtained.

11 Claims, No Drawings

LIGHT-SENSITIVE SILVER HALIDE COLOR PHOTOGRAPHIC MATERIAL

BACKGROUND OF THE INVENTION

This invention relates to a light-sensitive silver halide color photographic material, more particularly to a light-sensitive silver halide color photographic material which can be subjected to rapid developing processing, is improved in processing stability in said rapid developing processing, can be saved in silver and can be suppressed in generation of fog, and yet is capable of giving a color image of good light resistance (fastness to light).

Generally speaking, a light-sensitive silver halide color photographic material has three kinds of silver halide emulsion layers spectrally sensitized selectively so as to have sensitivity to blue light, green light and red light provided by coating on a support. For example, in a light-sensitive silver halide color photographic material for color negative, a blue-sensitive silver halide emulsion layer, a green-sensitive silver halide emulsion layer and a red-sensitive silver halide emulsion layer are generally provided by coating in this order from the side exposed, and a bleachable yellow filter layer is provided between the blue-sensitive silver halide emulsion layer and the green-sensitive silver halide emulsion layer for absorption of the blue light transmitted through the blue-sensitive silver halide emulsion layer. Further, it is practiced to provide other intermediate layers for various special purposes between the respective emulsion layers, and also a protective layer as the outermost layer. Further, for example, in a light-sensitive silver halide color photographic material for color printing paper, a red-sensitive silver halide emulsion layer, a green-sensitive silver halide emulsion layer and a blue-sensitive silver halide emulsion layer are generally provided by coating in this order from the side exposed, and there are also provided various intermediate layers for various special purposes, typically UV-ray absorbing layer, and a protective layer, etc., similarly as in the case of the light-sensitive silver halide color photographic material for color negative. These respective silver halide emulsion layers are also known to be provided in an arrangement different from those as mentioned above, and it is also known to use a light-sensitive silver halide emulsion layer comprising two layers having sensitivities to substantially the same wavelength regions relative to the respective color lights. In these light-sensitive silver halide color photographic material, the exposed silver halide grains are developed by using, for example, an aromatic primary amine type color developing agent as the color developing agent, and color images are formed through the reaction of the oxidized product of the color developing agent formed with a dye forming coupler. In this method, since dye images of cyan, magenta and yellow are generally formed, phenol or naphthol type cyan couplers, 5-pyrazolone type, pyrazolinobenzimidazole type, pyrazolotriazole type, indazolone type or cyanoacetyl type magenta couplers and acylacetamide type yellow couplers are used, respectively. These dye forming couplers are contained in the light-sensitive silver halide emulsion layers or developing solutions. This invention concerns a light-sensitive silver halide color photographic material in which these couplers are made non-diffusible and previously contained in the silver halide emulsion layers.

In recent years, in this field of the art, it has been desired to have a light-sensitive silver halide color photographic material, which can be processed rapidly, can give high image quality, is yet excellent in processing stability and can be produced at low cost, particularly a light-sensitive silver halide color photographic material which can be processed rapidly.

More specifically, it has been practiced to subject light-sensitive silver halide color photographic materials to running processing by means of automatic processing machines provided in respective laboratories. As a part for improvement of services for users, it is demanded to return the material subjected to the processing within the very day on which the order for processing is received. Quite recently, it became demanded to return the processed material within several hours from the receipt of order. Thus, development for light-sensitive silver halide color photographic materials capable of increasingly rapid processing is imminently demanded. Also, in running processing, between the respective laboratories or even in the same laboratory, photographic characteristics will be greatly changed due to the changes in compositions of processing solutions and fluctuations in conditions, thus involving a problem that stable photographic performances cannot be obtained. Such changes in compositions of processing solutions and fluctuations in conditions may be considered to be due to dissolution or accumulation of photographic active substances from the light-sensitive material during developing processing (running) or other causes. Thus, in order to accommodate fluctuations in processing conditions, it is required to highly control the developing time, the temperature and the pH of the developing solution, further the halogen concentration, particularly the bromo ion concentration, etc. in the developing solution. However, as compared with developing time or temperature and pH of the developing solution, the bromo ion concentration in the developing solution can be quantitated with difficulty to be poor in measurability, whereby it can be controlled with difficulty. Accordingly, it is particularly required to develop a light-sensitive silver halide color photographic material which is highly stabilized in processing with its photographic performanced being little dependent on the bromo ion concentration. Although there is also generally involved a problem in processing time, processing stability is a greater problem in rapid processing. Further, it is demanded that the light-sensitive silver halide color photographic material thus stabilized in processing should be provided economically at low cost, as a matter of course.

Now, to review the prior art techniques concerning light-sensitive silver halide color photographic materials enabling rapid processing, there have been known (1) the micropulverization technique of silver halide as disclosed in Japanese Unexamined Patent Publication No. 77223/1976; (2) the technique for reduction of silver bromide in silver halide as disclosed in Japanese Unexamined Patent Publication No. 184142/1983 and Japanese Patent Publication No. 18939/1981; the technique for adding 1-aryl-3-pyrazolidone having a specific structure to a light-sensitive silver halide color photographic material as disclosed in Japanese Unexamined Patent Publication No. 64339/1981, further the techniques for adding 1-arylpyrazolidones to light-sensitive silver halide color photographic materials as disclosed in Japanese Unexamined Patent Publications Nos. 144547/1982, 50534/1983, 50535/1983 and 50536/1983;

and otherwise (4) the technique to employ a color developing promoter in carrying out development of the exposed light-sensitive silver halide color photographic material with the use of an aromatic primary amine type color developing agent. For example, such color developing promotors may include the compounds as disclosed in U.S. Pat. Nos. 2,950,970, 2,515,147, 2,496,903, 4,038,075 and 4,119,462; U.K. Patent Nos. 1,430,998 and 1,455,413; Japanese Unexamined Patent Publications Nos. 15831/1978, 62450/1980, 62451/1980, 62452/1980 and 62453/1980; Japanese Patent Publications Nos. 12422/1976 and 49728/1980.

However, among these prior art techniques, when (3) or (4) is employed, although the processing time can be shortened, processing stability is poor in said rapid developing processing, and there is also involved a problem in the instant day performance.

And, when the reduced silver bromide emulsion of the above (2) is employed, although the bromo ion concentration in the processing solution can be set at a low level on account of the small amount of the bromo ions dissolved into the processing solution from the light-sensitive silver halide color photographic material containing said reduced silver bromide emulsion, there is involved the drawback that processing stability is poor when the light-sensitive silver halide color photographic material containing the reduced silver bromide emulsion is processed by use of a processing solution in which the bromo ion concentration is set at a low level. Here, processing stability refers to the degree of fluctuation in sensitometry to fluctuations in processing solution composition, pH, temperature, bromo ion concentration, etc. and entrainment of compounds other than the processing solution composition.

Also, when the micropulverized silver halide of the above (1) is employed, there is involved the drawback of inferior processing stability, and there is also observed the drawback that sensitivity is impaired as the grains become finer.

On the other hand, as for the prior art techniques for improvement of processing stability, there are techniques by way of improvement of processing solutions, as disclosed in Japanese Unexamined Patent Publications Nos. 121036/1984 and 120250/1984. However, to the best knowledge of the present inventors, there is no example in which processing stability is substantially improved by improvement of light-sensitive silver halide color photographic material, and it has been desired to develop a technique for improvement of processing stability by way of improvement of said light-sensitive material.

On the other hand, silver saving is a technical means for providing a light-sensitive silver halide color photographic material at low cost. Various techniques capable of effecting silver saving have been known, and use of a pyrazolotriazole type magenta coupler is one of the main techniques for silver saving. However, as a problem of a pyrazolotriazole type magenta coupler, a drawback has been pointed out that generation of fog in the instant day performance is high.

In order to overcome this problem, various attempts for improvement have been made. For example, there is a technique in which fog is inhibited by addition of an inhibitor, as disclosed in the Japanese Patent Application filed by the present Applicant on Sept. 1, 1984 (Title of the invention: Light-sensitive silver halide photographic material).

However, fog inhibition with an inhibitor will cause undesirably substantial lowering in sensitivity. Therefore, it has been desired to develop a light-sensitive silver halide color photographic material with little generation of fog.

Accordingly, the present inventors have previously proposed a technique as disclosed in Japanese Patent Application No. 202063/1984. Such a previously proposed technique is a light-sensitive silver halide color photographic material having a blue-sensitive silver halide emulsion layer, a green-sensitive silver halide emulsion layer and a red-sensitive silver halide emulsion layer on a support, wherein the mean grain size of the silver halide in the blue-sensitive silver halide emulsion layer is 0.20 to 0.55 μm, the content of silver bromide of the silver halides in said green-sensitive silver halide emulsion layer and red-sensitive silver halide emulsion layer is 5 to 65 mole %, and said green-sensitive silver halide emulsion layer contains at least one of the compounds represented by the formula [A] shown below:

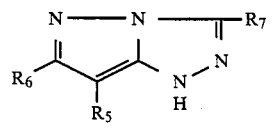

Formula [A]

wherein $R_5$ represents a halogen atom or a monovalent organic group eliminable through coupling reaction with the oxidized product of a developing agent. $R_6$ and $R_7$, which may be either identical or different, each represent a hydrogen atom, an alkyl group, an aryl group, a heterocyclic group, an acylamino group, an alkylamino group, an anilino group, an alkoxycarbonyl group, an alkylthio group, with proviso that $R_6$ and $R_7$ cannot be hydrogen atoms at the same time.

According to such a previously proposed technique, it is surely possible to provide a light-sensitive silver halide color photographic material which is capable of performing rapid developing processing, is improved in processing stability in said rapid developing, is capable of effecting silver saving, and also can inhibit generation of fog.

The present inventors have further continued to study about the above previously proposed technique and found out the following points.

Most of the couplers which were provided widely in practical applications as magenta dye image forming couplers and under progress of study in the prior art were 5-pyrazolones. The dyes formed from 5-pyrazolone type couplers are excellent in fastness to heat and light, but there exists an unnecessary absorption having a yellow component in the vicinity of 430 nm, which causes color turbidity.

As the coupler skeltal nucleus for forming a magenta dye image which can reduce the yellow component, a pyrazolobenzimidazole skeltal nucleus as disclosed in U.K. Patent No. 1,047,612, an indazolone skeltal nucleus as disclosed in U.S. Pat. No. 3,770,447 and a pyrazolotriazole skeltal nucleus have been known.

Among them, the dye formed from the 1H-pyrazolo[3,2-c]-s-triazole type coupler is little in unnecessary absorption in the vicinity of 430 nm in a solvent such as ethyl acetate, dibutyl phthalate, etc., and besides excellent in sharp cut characteristic on the longer wavelength side, but fastness to light of the azomethyne dye is markedly low, whereby performances of light-sensitive color photographic materials, particularly print type light-sensitive color photographic materials, are markedly impaired.

SUMMARY OF THE INVENTION

This invention has been accomplished in view of the state of the art as described above, and its technical task is to provide a light-sensitive silver halide color photographic material which is capable of performing rapid developing processing, is improved in processing stability in said rapid developing, is capable of effecting silver saving, can also inhibit generation of fog, and yet is good in light resistance.

The light-sensitive silver halide color photographic material which overcomes the above technical task is a light-sensitive silver halide color photographic material having photographic constituent layers including a blue-sensitive silver halide emulsion layer, a green-sensitive silver halide emulsion layer and a red-sensitive silver halide emulsion layer, wherein the content of silver bromide of the silver halides in said green-sensitive silver halide emulsion layer and red-sensitive silver halide emulsion layer is 5 to 65 mole %, and said green-sensitive silver halide emulsion layer contains at least one of the compounds represented by the formula [I] shown below (hereinafter refers to as pyrazolotriazole type magenta coupler of this invention):

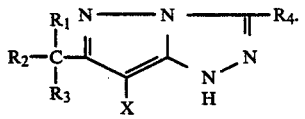

Formula [I]

In the above formula, X represents a halogen atom or a monovalent organic group eliminable through coupling reaction with the oxidized product of a developing agent. $R_1$ to $R_3$, which may be either identical or different, each represent a hydrogen atom, a halogen atom (e.g. chlorine, bromine, fluorine, etc.), an alkyl group (a straight or branched alkyl group having 1 to 32 carbon atoms which may have substituents, including specifically methyl, propyl, t-butyl, hexadecyl, 3-(3-pentadecylphenoxy)propyl, 3-(2,4-di-tert-amylphenoxy)-propyl, 3-(2,4-di-tert-amylphenoxy)ethyl, 3-(4-di-tert-amylphenoxy)propyl, 2-[α-(3-tert-butyl-4-hydroxyphenoxy)-tetradecanamidoethyl] group, etc.), a cycloalkyl group (e.g. cyclohexyl group, etc.), an alkenyl group (e.g. propenyl group, etc.), a cycloalkenyl group, an alkynyl group, an aryl group (e.g. phenyl, α or β-naphthyl, 4-methylphenyl, 2,4,6-trichlorophenyl, 4-[α-(3-tert-butyl-4-hydroxyphenoxy)tetradecaneamido]-2,6-dichlorophenyl group, etc.), a heterocyclic group (e.g. pyridiyl, thienyl, quinolyl group, etc.), an acyl group (e.g. acetyl, benzoyl group, etc.), a sulfonyl group, a sulfinyl group, a phosphonyl group (e.g. butyloctylphosphonyl group, etc.), a carbamoyl group, a sulfamoyl group, a cyano group, a spiro compound residue (e.g. spiro(3,3)heptane-1-yl, etc.), a bridged hydrocarbon compound residue (e.g. bicyclo(2,2,1)heptane-1-yl, etc.), an alkoxy group (e.g. methoxy, ethoxy, propoxy, isopropoxy, n-butoxy group, etc.), an aryloxy group (e.g. phenoxy group, etc.), a heterocycloxy group (e.g. 1-phenyltetrazolyloxy group, etc.), a siloxy group (e.g. trimethylsiloxy group, etc.), an acyloxy group (e.g. acetyloxy group, etc.), a carbamoyloxy group, an amino group, an acylamino group (e.g. acetylamino, benzamide, 3-(2,4-di-tert-amyl-phenoxybutylamide), 3-(3-pentadecylphenoxy)butylamide group, etc.), a sulfonamide group (e.g. methanesulfonamide group, etc.), an imido group (e.g. succinimide group, etc.), a ureido group, a sulfamoylamino group, an alkoxycarbonylamino group (e.g. methoxycarbonylamino, tetradecyloxycarbonylamino group, etc.), an aryloxycarbonylamino group (e.g. phenoxycarbonylamino group, etc.), an alkoxycarbonyl group (e.g. methoxycarbonyl group, etc.), an aryloxycarbonyl group (e.g. phenoxycarbonyl group, etc.), an alkylthio group (e.g. hexylthio, dodecylthio group, etc.), an arylthio group (e.g. phenylthio group, etc.) or a heterocyclic thio group (e.g. 3-pyridylthio group, etc.), with proviso that at least two of $R_1$ to $R_3$ are not hydrogen atoms. $R_4$ represents a hydrogen atom, an alkyl group (a straight or branched alkyl group having 1 to 32 carbon atoms which may have substituents, including specifically methyl, propyl, t-butyl, hexadecyl, 3-(3-pentadecylphenoxy)propyl, 3-(2,4-di-tert-amyl-phenoxy)-propyl, 2-(2,4-di-tert-amylphenoxy)propyl, 3-(dodecylsulfonyl)-propyl, 2-(2,4-di-tert-amylphenoxy)ethyl, 3-(2,4-di-tert-amylphenoxy)propyl, 2-[α-(3-tert-butyl-4-hydroxyphenoxy)tetradecaneamidoethyl] group, etc., an aryl group (e.g. phenyl, α or β-naphthyl, 4-methylphenyl, 2,4,6-trichlorophenyl, 4-[α-(3-tert-butyl-4-hydroxyphenoxy)tetradecaneamido]-2,6-dichlorophenylgroup, etc.), a heterocyclic group (e.g. pyridyl, thienyl, quinolyl group, etc.), an acylamino group (e.g. acetylamino, benzamide, 3-(2,4-di-tert-amylphenoxy)-butylamide, 3-(3-pentadecylphenoxy)butylamide group, etc.), an alkylamino group (e.g. methylamino, diethylamino, n-dodecylamino group, etc.), an anilino group (e.g. phenylamino, 2-chloro-5-tetradecaneamidophenylamino, 4-[α-(3-t-butyl-4-hydroxyphenoxy)tetradecaneamido]anilino group, etc.), an alkoxycarbonyl group (e.g. methoxycarbonyl, tetradecyloxycarbonyl group, etc.), an alkylthio group (e.g. hexylthio, dodecylthio group, etc.).

That is, the present inventor continued to study intensively in order to overcome the technical task as mentioned above, and consequently found out that its object could be accomplished by applying the pyrazolotriazole type magenta coupler of said formula [I] for the previously proposed technique as mentioned above.

DESCRIPTION OF THE PREFERRED EMBODIMENTS

The silver halides contained in the green-sensitive silver halide emulsion layer and the red-sensitive silver halide emulsion layer, respectively, of this invention may be silver chlorobromide, silver chloroiodobromide or mixtures thereof (or mixtures containing partially silver chloride or silver bromide), with the content of silver bromide being 5 to 65 mole %, respectively. One or both of the green-sensitive silver halide emulsion layer and the red-sensitive silver halide emulsion layer in this invention may comprise two or more layers. And, the silver bromide content as mentioned in this invention refers to the content of all the silver bromide in respective layers occupied in all the silver halides contained in the respective layers of the whole green-sensitive silver halide emulsion layers and the whole red-sensitive silver halide emulsion layers. If the silver bromide content exceeds 65 mole %, processing stability will be worsened to cause color turbidity of magenta. On the other hand, if the silver bromide content is less than 5 mole %, processing stability will be markedly deteriorated. When the silver halide contained in the green-sensitive silver halide emulsion layer and the red-sensitive silver halide emulsion layer is silver chloroiodobromide, the silver iodide content in each layer should preferably be not more than 2 mole %.

The preferable silver bromide content in each of the green-sensitive silver halide emulsion layer and the red-sensitive silver halide emulsion layer is 20 to 60 mole %, more preferably 30 to 55 mole %.

The silver halide contained in the green-sensitive silver halide emulsion layer and the red-sensitive silver halide emulsion layer of this invention should preferably be substantially mono-dispersed. Similarly, the silver halide contained in the above blue-sensitive silver halide emulsion layer should also preferably be substantially mono-dispersed.

The composition of the silver halide contained in the blue-sensitive silver halide emulsion layer is not particularly limited, but may be any of silver chloride, silver bromide, silver chlorobromide and silver chloroiodobromide or a mixture thereof, preferably silver chlorobromide, with the content of silver bromide being preferably 30 to 95 mole %. Also, the blue-sensitive silver halide emulsion layer in this invention may comprise two or more layers.

The mean grain size of the silver halide contained in the green-sensitive silver halide emulsion layer and the red-sensitive silver halide emulsion layer is not particularly limited, but may be preferably each 0.1 to 2 μm, more preferably each 0.2 to 1 μm, particularly each 0.25 to 0.8 μm.

The silver halide contained in the blue-sensitive silver halide emulsion layer of this invention should preferably have a mean grain size of 0.20 to 0.55 μm, more preferably 0.30 to 0.50 μm. For maintaining good processing stability, particularly good processing stability in the case when the amount of potassium bromide is changed, a mean grain size of 0.55 μm is preferable, while a mean grain size of 0.20 μm is preferable for high sensitivity of the blue-sensitive silver halide emulsion layer and prevention of color turbidity of magenta.

Next, the pyrazolotriazole type magenta coupler of Formula [I] of this invention is to be described in more detail.

In Formula [I] representing the pyrazolotriazole type magenta coupler of this invention, preferably, at least two of $R_1$, $R_2$ and $R_3$ each represent an alkyl group, X represents a halogen atom, and $R_4$ represents an alkyl group.

The pyrazolotriazole type magenta coupler of this invention is contained in the green-sensitive silver halide emulsion layer and, when said green-sensitive silver halide emulsion layer consists of two or more layers, it may be contained in at least one green-sensitive silver halide emulsion layer.

The amount of the pyrazolotriazole type magenta coupler added is not limitative, but preferably $2\times10^{-3}$ to $5\times10^{-1}$ mole, more preferably $1\times10^{-2}$ to $5\times10^{-1}$ mole, per mole of silver contained in the green-sensitive silver halide emulsion layer.

The pyrazolotriazole type magenta coupler to be used in this invention may include the compounds as disclosed in, for example, Japanese Patent Applications Nos. 241648/1984, 243007/1984, 243008/1984, 243009/1984, 243010/1984, 243011/1984, etc.

The pyrazolotriazole type magenta coupler to be used in this invention can be synthesized as described in these patent specifications.

Specific examples of the pyrazolotriazole type magenta coupler of this invention are enumerated below, but this invention is not limited thereto.

[Exemplary compound]

(1)

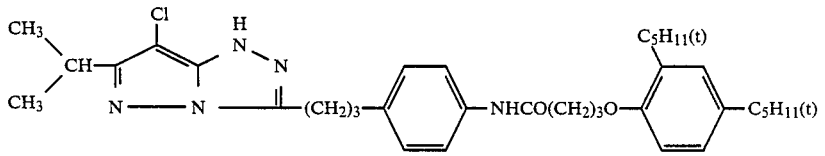

(2)

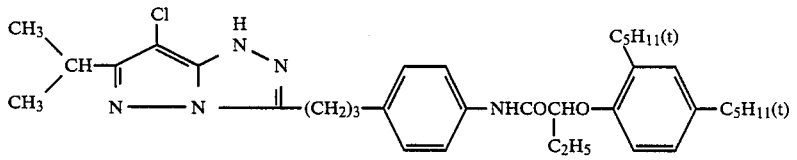

(3)

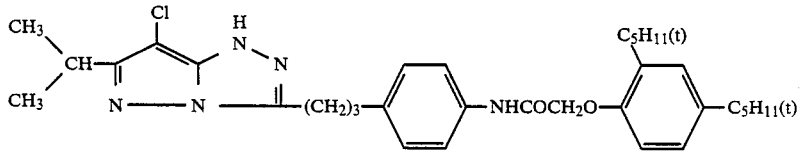

(4)

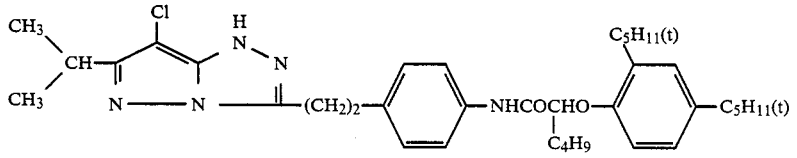

-continued
[Exemplary compound]
(5)
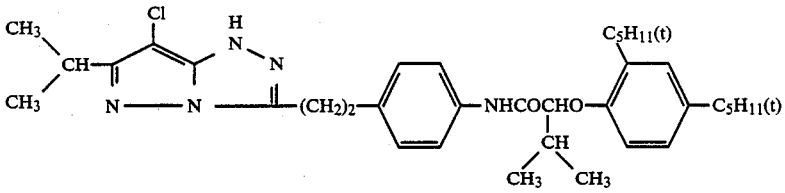
(6)
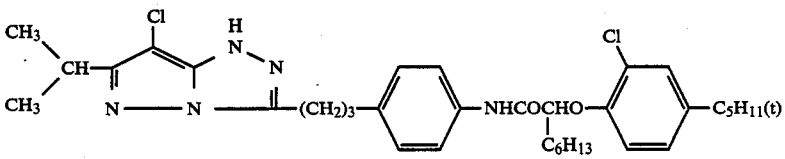
(7)
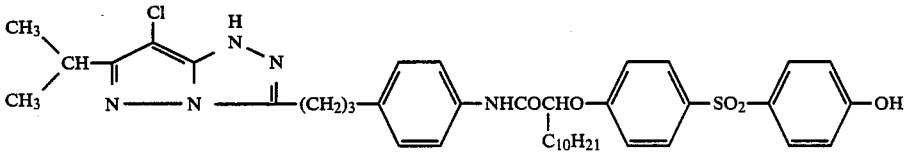
(8)
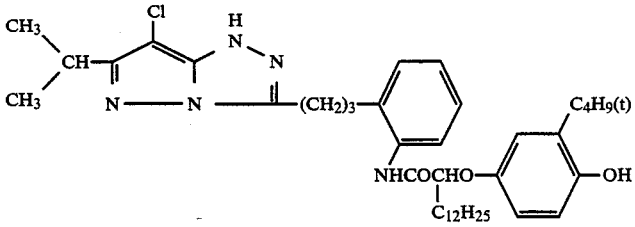
(9)
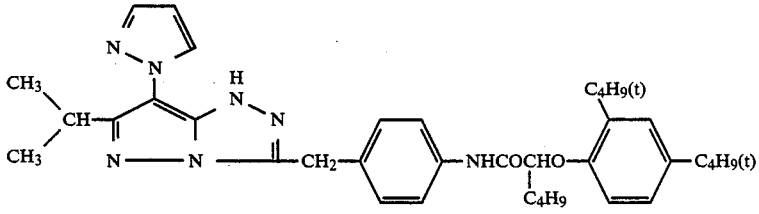
(10)
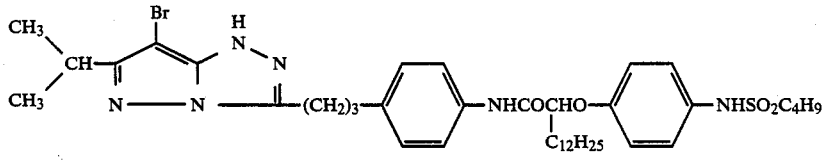
(11)
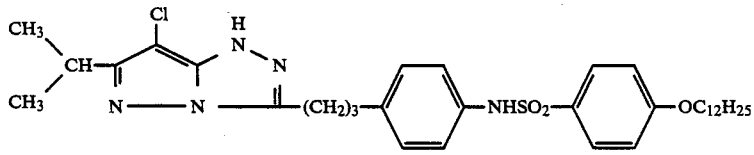
(12)
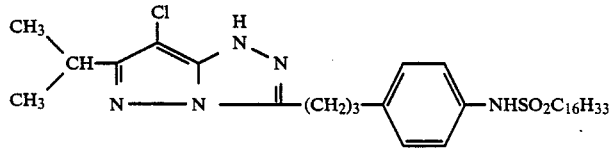

-continued
[Exemplary compound]
(13)
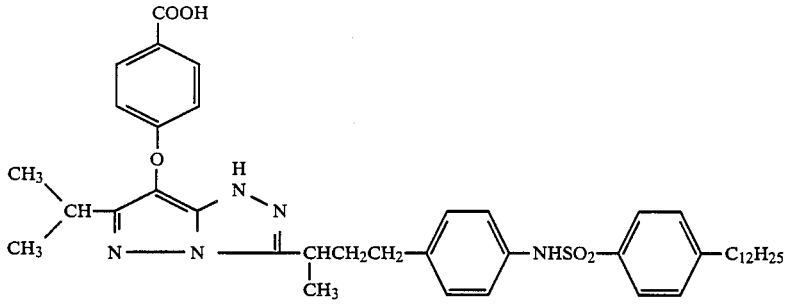
(14)
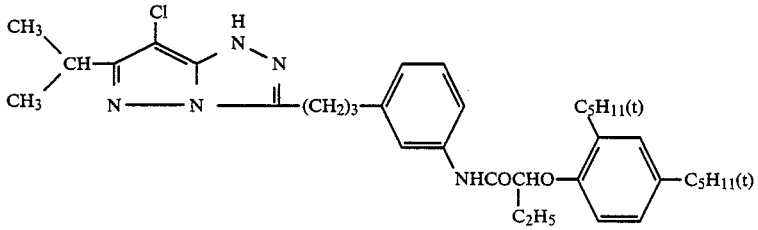
(15)
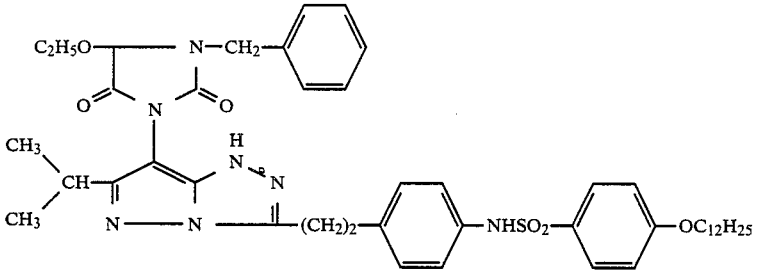
(16)
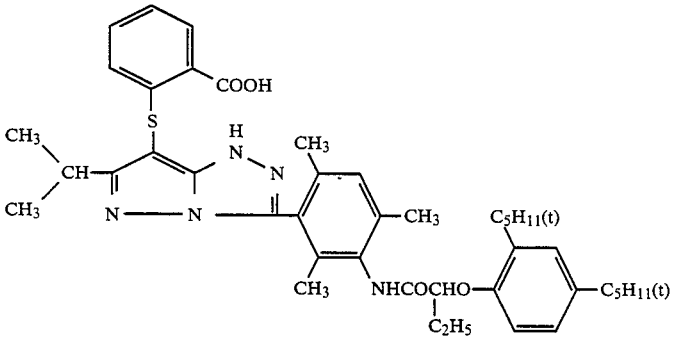
(17)
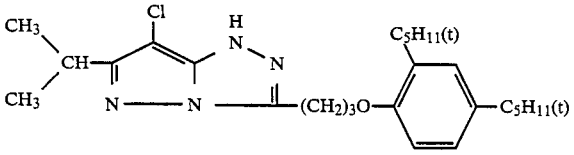
(18)
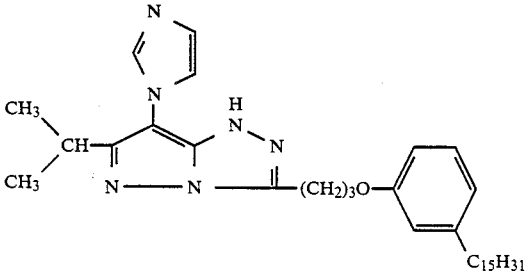

-continued
[Exemplary compound]
(19)
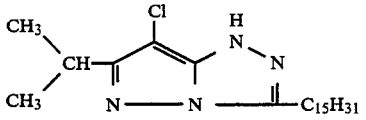
(20)
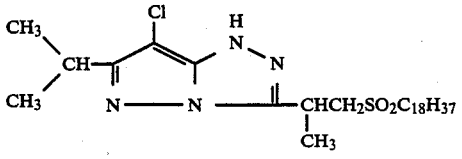
(21)
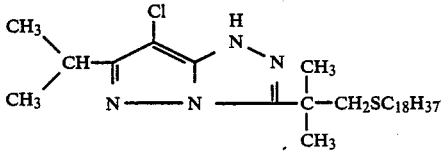
(22)
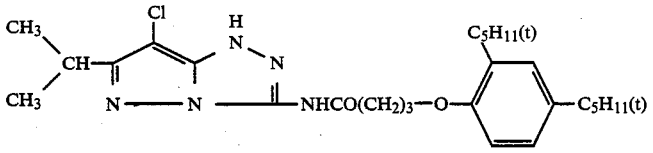
(23)
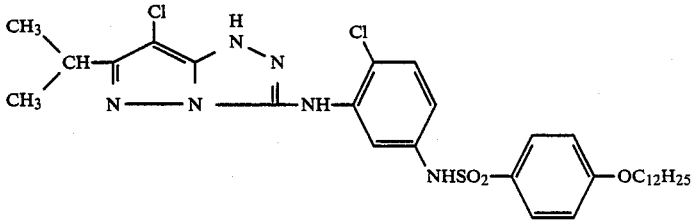
(24)
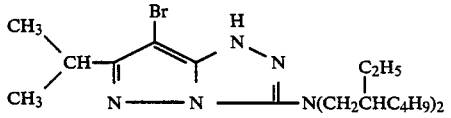
(25)
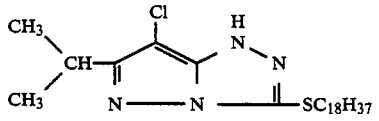
(26)
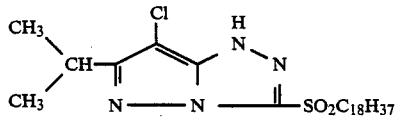
(27)
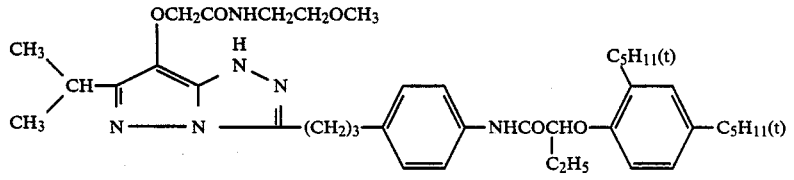

-continued
[Exemplary compound]
(28)
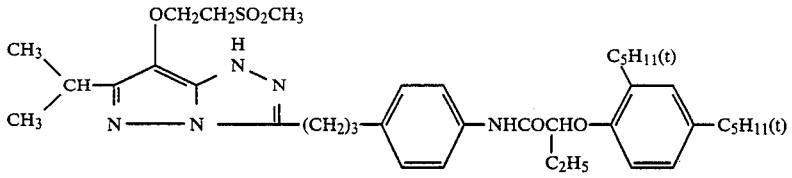
(29)
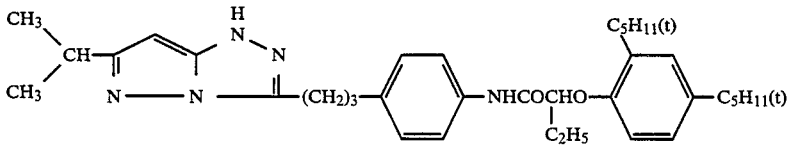
(30)
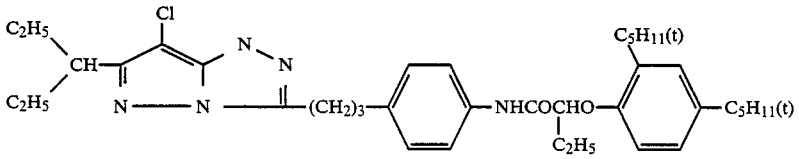
(31)
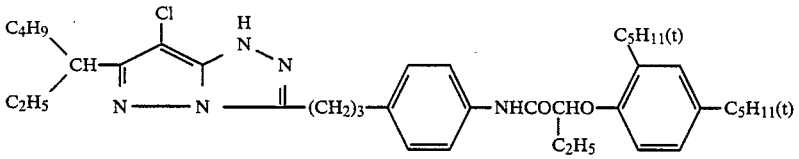
(32)
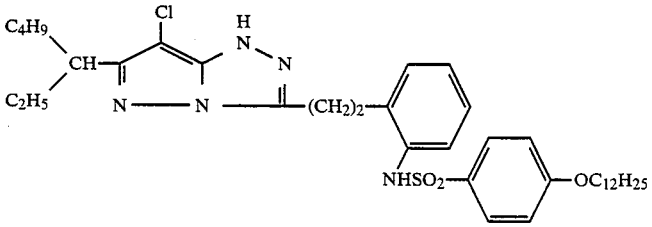
(33)
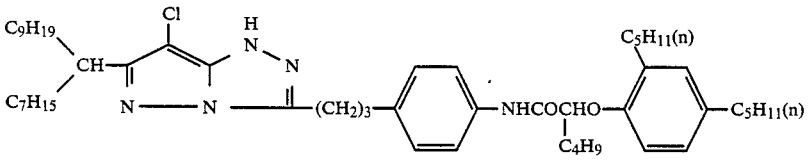
(34)
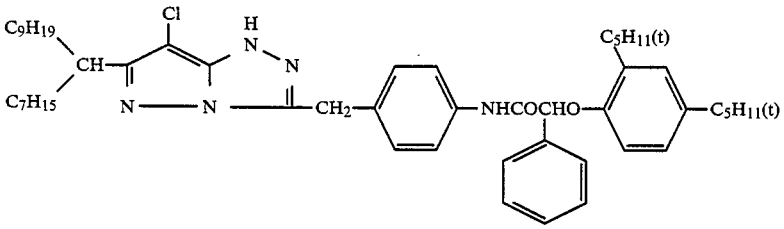
(35)
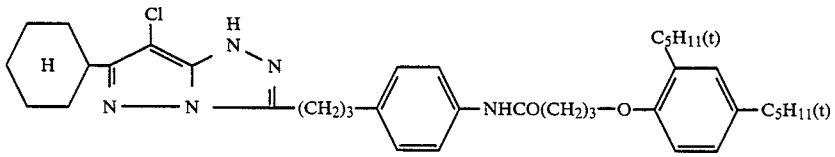

-continued
[Exemplary compound]
(36)
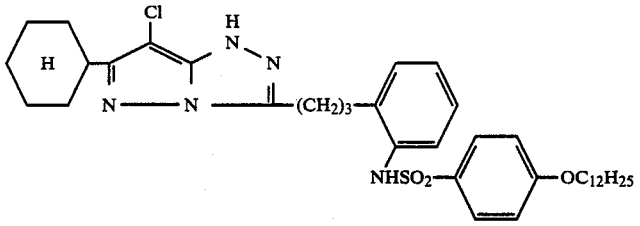
(37)
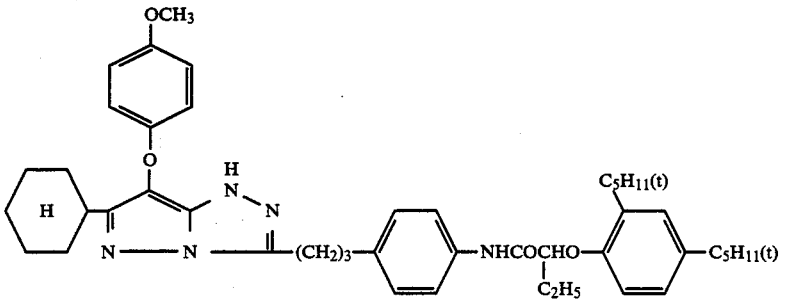
(38)
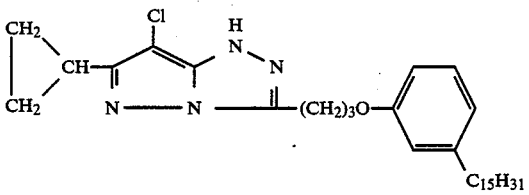
(39)
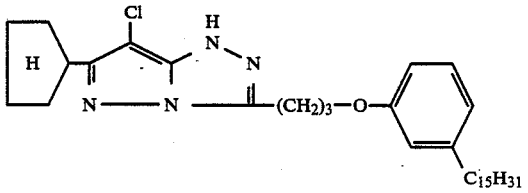
(40)
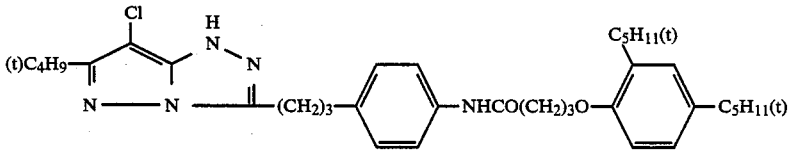
(41)
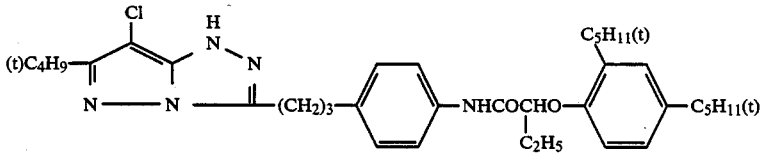
(42)
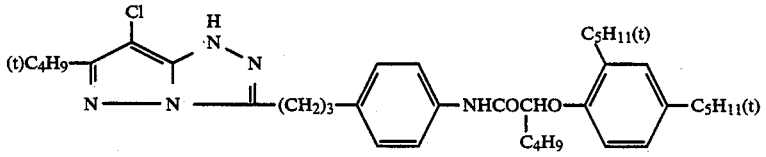
(43)
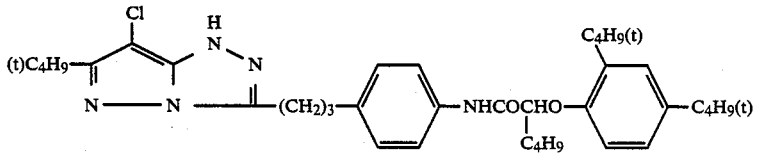

-continued

[Exemplary compound]

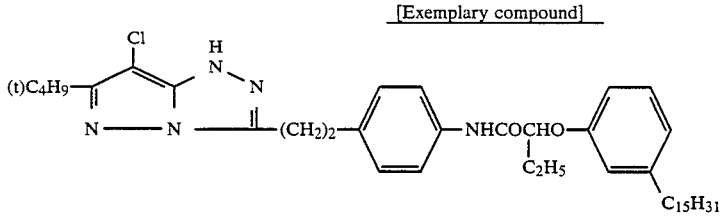

(44)

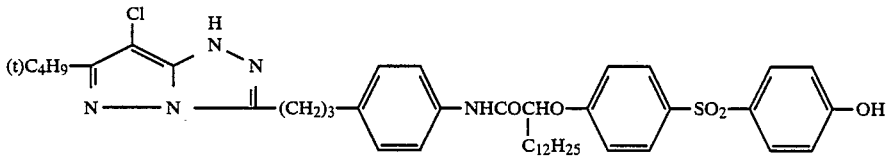

(45)

The mean grain size of the silver halide contained in the blue-sensitive silver halide emulsion layer of this invention can be measured according to various methods generally used in this field of the art. Typical methods are described in Rabland, "Method of analyzing grain size", A.S.T.M. Symposium on Light Microscopy, 1955, pp. 94–122 or "Theory of Photographic Process" written by Mieth and James, Third Edition, published by Macmillan Co. (1966), Chap. 2. The grain size can be measured by use of the projected area or the approximate diameter value of the grain. When the grains have substantially uniform shapes, the grain size distribution can be represented considerably accurately as diameter or projected area.

The above substantially mono-dispersed silver halide grains of this invention refer to those which appear to be consist mostly of the silver halide grains with the same shape when the emulsion is observed with an electron microscope photograph, having uniform grain sizes, with a value of the standard deviation s of the grain size distribution divided by the mean grains size $\bar{r}$ being 0.15 or less.

The amount of silver in the silver halide emulsion layer in the light-sensitive silver halide color photographic material (attached silver amount) is not limitative, but may preferably be 0.3 to 1 g/m$^2$ in the light-sensitive silver halide emulsion layers as a whole. That is, in order to obtain excellent image quality, said silver amount should preferably be 1 g/m$^2$ or less, while, in order to obtain high maximum density and high sensitivity, said silver amount should preferably be 0.3 g/m$^2$ or more. In this invention, particularly preferable silver amount is 0.4 to 0.8 g/m$^2$.

The crystals of these silver halide grains may be either normal crystals, twin crystal or others, and crystals with any desired ratio of [1.0.0] plane to [1.1.1] plane may be available. Further, the crystalline structure of these silver halide grains may be uniform from the inner portion to the outer portion, or consist of a layer structure in which the inner portion and the outer portion are different from each other (core-shell type). Also, these silver halides may be either of the type in which latent images are formed mainly on their surfaces or of the type in which latent images are formed internally of the grains. Further, silver halide grains shaped in flat plates (see Japanese Patent Application No. 170070/1984) can also be used.

The substantially mono-dispersed silver halide grains to be preferably used in this invention may be obtained according to any preparation method well known in the art such as the acidic method, the neutral method or the ammonia method.

For example, there may be employed the method in which seed grains are prepared by the acidic method, and further the seed grains are grown by the ammonia method with rapid growth speed to desired sizes. When the silver halide grains are grown, it is preferable to control pH, pAg, etc. in a reactor and inject successively at the same time silver ions and halide ions in amounts corresponding to the growth speed of the silver halide grains as described in, for example, Japanese Unexamined Patent Publication No. 48521/1979.

Preparation of silver halide grains according to this invention should preferably be conducted as described above. The composition containing said silver halide grains is referred to as silver halide emulsion in the present specification.

These silver halide emulsions may be chemically sensitized with a single sensitizer or a suitable combination of sensitizers (e.g. combination of a gold sensitizer and a sulfur sensitizer, combination of a gold sensitizer and a selenium sensitizer. Such sensitizers may include activated gelatin; sulfur sensitizers such as arylthiocarbamide, thiourea, cystine, etc.; selenium sensitizers; reducing sensitizers such as stannous salts, thioureaa dioxide, polyamines, etc.; noble metal sensitizers such as gold sensitizers, specifically potassium aurithiocyanate, potassium chloroaurate, 2-aurothio-3-methylbenzothiazolium chloride, etc., or sensitizers of water soluble salts of, for example, ruthenium, palladium, platinum, rhodium, iridium, etc., specifically ammonium chloropalladate, potassium chloroplatinate, sodium chloropalladate (some of these may act as sensitizers or fogging inhibitors depending on the amount), etc.

The silver halide emulsion according to this invention may be prepared by carrying out chemical aging with addition of a sulfur-containing compound and incorporating at least one of hydroxytetrazaindene and nitrogen-containing heterocyclic compounds having mercapto group before, during or after the chemical aging.

The silver halides to be used in this invention may also be optically sensitized with addition of $5\times10^{-8}$ to $3\times10^{-3}$ mole of a suitable sensitizing dye in order to impart light-sensitivity to the respective desired light-sensitive wavelength regions. As the sensitizing dye, various dyes can be used and a combination with one dye or two or more dyes can also be used. The sensitizing dyes which can be advantageously used in this invention are mentioned below.

That is, as the sensitizing dye to be used in the blue-sensitive silver halide emulsion, there may be included those as disclosed in West German Patent No. 9 29 080; U.S. Pat. Nos. 2,231,658, 2,493,748, 2,503,776, 2,519,001, 2,912,329, 3,656,959, 3,672,897, 3,694,217, 4,025,349 and 4,046,572; U.K. Patent No. 1,242,588; Japanese Patent Publications Nos. 14030/1969 and 24844/1977. As the sensitizing dye to be used in the green-sensitive silver halide emulsion, there may be included cyanine dyes, merocyanine dyes or complex cyanine dyes as disclosed in, for example, U.S. Pat. Nos. 1,939,201, 2,072,908, 2,739,149 and 2,945,763; and U.K. Patent No. 505,979, as representative ones. Further, as the sensitizing dye to be used in the red-sensitive silver halide emulsion, there may be included cyanine dyes, merocyanine dyes or complex cyanine dyes as disclosed in, for example, U.S. Pat. Nos. 2,269,234, 2,270,378, 2,442,710, 2,454,629 and 2,776,280, as representative ones. Furthermore, cyanine dyes, merocyanine dyes or complex cyanine dyes as disclosed in U.S. Pat. Nos. 2,213,995, 2,493,748 and 2,519,001 and West German Patent No. 9 29 080 can also advantageously be used in the green-sensitive silver halide emulsion or the red-sensitive silver halide emulsion.

These sensitizing dyes may be used either singly or as a combination of these.

The light-sensitive photographic material of this invention may also be subjected to optical sensitization to a desired wavelength region according to the spectral sensitizing method by using cyanine or merocyanine dyes either singly or in combination.

Typical examples of the particularly preferred spectral sensitizing dye may include the methods concerning the combination of benzimidazolocarbocyanine and benzo-oxazolocarbocyanine as disclosed in Japanese Patent Publications Nos. 4936/1968, 22884/1968, 18433/1970, 37443/1972, 28293/1973, 6209/1974 and 12375/1978; Japanese Unexamined Patent Publications Nos. 23931/1977, 51932/1977, 80118/1979, 153926/1983, 116646/1984 and 116647/1984.

Concerning the combination of carbocyanine having benzimidazole nucleus and cyanine or merocyanine, there may be included, for example, Japanese Patent Publications Nos. 25831/1970, 11114/1972, 25379/1972, 38406/1973, 38407/1973, 34535/1979 and 1569/1980; Japanese Unexamined Patent Publications Nos. 33220/1975, 38526/1975, 107127/1976, 115820/1976, 135528/1976, 104916/1977 and 104917/1977.

Further, concerning the combination of the benzo-oxazolocarbocyanine (oxa-carbocyanine) and other carbocyanines, there may be included, for example, Japanese Patent Publications Nos. 32753/1969 and 11627/1971; Japanese Unexamined Patent Publication No. 1483/1982; and, concerning the combination with merocyanine, there may be included Japanese Patent Publications Nos. 38408/1973, 41204/1973 and 40662/1975; Japanese Unexamined Patent Publications Nos. 25728/1981, 10753/1983, 91445/1983, 116645/1984 and 33828/1975.

Also, concerning the combination of thiacarbocyanine with other carbocyanines, there may be included, for example, Japanese Patent Publications Nos. 4932/1968, 4933/1968, 26470/1970, 18107/1971 and 8741/1972; Japanese Unexamined Patent Publication No. 114533/1984. Further, it is possible to use advantageously the method as disclosed in Japanese Patent Publication No. 6207/1974 using zeromethyne, dimethynemerocyanine, monomethyne or trimethynecyanine and a styryl dye.

For addition of these sensitizing dyes into the silver halide emulsion according to this invention, they can be used as the dye solutions by dissolving them previously in hydrophilic organic solvents such as methyl alcohol, ethyl alcohol, acetone, dimethylformamide or fluorinated alcohols as disclosed in Japanese Patent Publication No. 40659/1975.

The timing of addition may be either at initiation of chemical aging of the silver halide emulsion, during the chemical aging or on completion of the chemical aging. In some cases, they can be added also in the step immediately before coating of the emulsion.

In the light-sensitive silver halide color photographic material of this invention, there may also be incorporated water-soluble dyes as filter dyes in hydrophilic colloid layers or for various other purposes such as irradiation prevention, etc. Such dyes may include oxonol dyes, hemioxonol dyes, merocyanine dyes and azo dyes. Among them, oxonol dyes, hemioxonol dyes and merocyanine dyes are useful. Specific examples of available dyes are disclosed in U.K. Patents Nos. 584,609 and 1,277,429; Japanese Unexamined Patent Publications Nos. 85130/1973, 99620/1974, 114420/1974, 129537/1974, 108115/1977, 25845/1984; U.S. Pat. Nos. 2,274,782, 2,533,472, 2,956,879, 3,125,448, 3,148,187, 3,177,078, 3,247,127, 3,540,887, 3,575,704, 3,653,905, 3,718,472, 4,071,312 and 4,070,352.

The green-sensitive silver halide emulsion layer according to this invention contains the pyrazolotriazole type magenta coupler of this invention, and a magenta coupler other than those of this invention may also be used in combination in said green-sensitive silver halide emulsion layer. However, it is preferred that the magenta coupler other than those of this invention should preferably be less than 45 mole % based on the total amount of the magenta couplers. Also, in the blue-sensitive silver halide emulsion layer and the red-sensitive silver halide emulsion layer, respectively, couplers, namely the compounds capable of forming dyes through the reaction with the oxidized product of a color developing agent can be contained.

In this invention, as the above couplers, conventional yellow couplers, magenta couplers and cyan couplers can be used. These couplers may be either the so called divalent type or the tetravalent type, and it is also possible to use couplers of the diffusible dye release type by combination of these couplers.

As the above yellow couplers, there may be used without any limitation closed chain ketomethylene compounds, and further the so called divalent type couplers, including active site-o-aryl-substituted couplers, active site-o-acyl-substituted couplers, active site hydantoin compound-substituted couplers, active site urazole compound-substituted couplers, active site succinimide compound-substituted couplers, active site fluorine-substituted couplers, active site chlorine- or bromine-substituted couplers, active site-o-sulfonyl-substituted couplers and the like.

As the above magenta couplers to be used in this invention, there may be included the compounds of pyrazolone type, pyrazolotriazole type other than those of this invention, pyrazolinobenzimidazole type, and indazolone type.

These magenta couplers may be also the divalent type couplers in addition to the tetravalent type couplers, similarly as the yellow couplers. Specific examples of magenta couplers may include those disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Patent No. 18 10 464; West German laid-open Patent Applications Nos. (OLS) 24 08 665, 24 17 945, 24 18 959 and 24 24 467; Japanese Patent Publication No. 6031/1965; Japanese Unexamined Patent Publications Nos. 20826/1976, 58922/1977, 129538/1974, 74027/1974, 159336/1975, 42121/1977, 74028/1974, 60233/1975, 26541/1976, 55122/1978 and 35858/1982.

Further, useful cyan couplers to be used in this invention may include, for example, phenol type and naphthol type couplers. And, these cyan couplers may be also the divalent type couplers in addition to the tetravalent type couplers, similarly as the yellow couplers. Specific examples of cyan couplers may include those as disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494 and 4,004,929; West German laid-open Patent Applications Nos. (OLS) 24 14 830 and 24 54 329; Japanese Unexamined Patent Publications Nos. 59838/1973, 26034/1976, 5055/1973, 146827/1976, 69624/1977, 90932/1977, 95346/1983 and 11572/1974.

For incorporating the pyrazolotriazole type magenta coupler of this invention and other couplers in the silver halide emulsion according to this invention, when said couplers are alkali-soluble, they may be added as alkaline solutions; when they are oil-soluble, they can preferably be dissolved in a high boiling solvent, optionally together with a low boiling solvent, according to the methods as disclosed in U.S. Pat. Nos. 2,322,027, 2,801,170, 2,801,171, 2,272,191 and 2,304,940, to be dispersed in fine particles before addition into the silver halide emulsion. If desired, a hydroquinone derivative, a UV-ray absorber, a color fading preventive, etc. may also be used in combination. Also, two or more kinds of couplers may be used as a mixture. Further, to describe in detail about the method for addition of couplers, one or two or more kinds of said couplers optionally together with other couplers, a hydroquinone derivative, a color fading preventive, a UV-ray absorber, etc., are dissolved in a high boiling solvent such as organic acid amides, carbamates, esters, ketones, urea derivatives, ethers, hydrocarbons, specifically di-n-butylphthalate, tricresyl phosphate, triphenyl phosphate, di-isooctylazelate, di-n-butylsebacate, tri-n-hexylphophate, N,N-diethylcaprylamidobutyl, N,N-diethyllaurylamide, n-pentadecylphenylether, dioctylphthalate, n-nonylphenol, 3-pentadecylphenyl ethyl ether, 2,5-di-sec-amylphenyl butyl ether, monophenyl-di-o-chlorophenyl phosphate or fluoroparaffins, and/or a low boiling solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane, tetrahydrofuran, methyl alcohol, acetonitrile, dimethylformamide, dioxane, methyl ethyl ketone, etc., the resultant solution is mixed with an aqueous solution containing an anionic surfactant such as alkylbenzenesulfonic acid and alkylnaphthalenesulfonic acid and/or a nonionic surfactant such as sorbitane sesquioleic acid ester and sorbitane monolauryl acid ester and/or a hydrophilic binder such as gelatin, etc., emulsified by means of a high speed rotary mixer, a colloid mill or a sonication dispersing device, etc. and added into the silver halide emulsion.

Otherwise, the above coupler may also be dispersed by use of the latex dispersing method. The latex dispersing method and its effect are described in Japanese Unexamined Patent Publications Nos. 74538/1974, 59943/1976 and 32552/1979 and Research Disclosure, August, 1976, No. 14850, pp. 77–79.

Suitable latices are homopolymers, copolymers or terpolymers of monomers such as styrene, acrylate, n-butyl acrylate, n-butylmethacrylate, 2-acetoacetoxyethyl methacrylate, 2-(methacryloyloxy)ethyltrimethylammoniummethosulfate, sodium 3-(methacryloyloxy)propane-1-sulfonate, N-isopropylacrylamide, N-[2-(2-methyl-4-oxopentyl)]acrylamide, 2-acrylamide-2-methylpropanesulfonic acid, etc.

In the light-sensitive silver halide color photographic material of this invention, various kinds of other additives for photography can be contained. For example, there can be employed antifoggants, stabilizers, UV-ray absorbers, color staining preventives, fluorescent brighteners, color image fading preventives, antistatic agents, film hardeners, surfactants, plasticizers, wetting agents, etc. In the light-sensitive silver halide color photographic material of this invention, the hydrophilic colloid to be used for preparation of the emulsion may include any of gelatin, gelatin derivatives, graft polymer of gelatin with other polymers, proteins such as albumin, casein, etc., cellulose derivatives such as hydroxyethyl cellulose, carboxymethyl cellulose, etc., starch derivaties, synthetic hydrophilic homopolymers or copolymers such as polyvinyl alcohol, polyvinyl imidazole, polyacrylamide, etc.

As the support for light-sensitive silver halide color photographic material of this invention, there may be employed, for example, baryta paper, polyethylene-coated paper, polypropylene synthetic paper, transparent supports provided with reflective layer or employing a reflective material in combination, such as glass plate, polyester films such as cellulose acetate, cellulose nitrate or polyethyleneterephthalate, polyamide filme, polycarbonate film, polystyrene film, etc. Further, conventional transparent supports may also be used, and these supports may be suitably selected depending on the purpose of use of the light-sensitive material.

For coating of the emulsion layers and other constituent layers to be used in this invention, it is possible to use various coating methods such as dipping coating, air doctor coating, curtain coating, hopper coating, etc. Also, simultaneous coating method of two or more layers can also be used as disclosed in U.S. Pat. Nos. 2,761,791 and 2,941,898.

In this invention, the coating positions for respective emulsion layers can be determined as desired. For example, in the case of a light-sensitive material for printing paper of full color, it is preferred to arrange the layers successively in the order of the blue-sensitive silver halide emulsion layer, the green-sensitive silver halide emulsion layer and the red-sensitive silver halide emulsion layer from the support side.

In the light-sensitive material of this invention, intermediates layers with suitable thicknesses may be provided as desired depending on the purpose, and further various layers such as filter layer, curl prevention layer, protective layer, anti-halation layer, etc. can also be suitably used as constituent layers in combination. These constituent layers can similarly use the hydrophilic colloid which can be used in the silver halide emulsion layers as described above, and various additives for photography which can be contained in the silver halide emulsion layers as described above can also be contained therein.

The method for processing the light-sensitive photographic material using the silver halide emulsion according to this invention is not particularly limited, but all processing methods are applicable. For example, there may be employed typically any of the method in which, after color development, bleach-fixing processing is performed, followed optionally by water washing and/or stabilizing processing; the method in which, after color development, bleaching and fixing are performed separately, followed optionally by water washing and/or stabilizing processing; the method in which pre-film-hardening, neutralization, color developing, stopping fixing, water washing, bleaching, fixing, water washing, post-film-hardening and water washing are performed in this order; the method in which color developing, water washing, supplemental color developing, stopping, bleaching, fixing, water washing and stabilizing are performed in this order; the developing method in which the developed silver formed by color developing is subjected to halogenation bleach, followed by color developing again to increase the amount of the dye formed; etc.

The color developing solution to be used in processing of the silver halide emulsion layer according to this invention is an aqueous alkaline solution containing a color developing agent having a pH preferably of 8 or more, more preferably of 9 to 12. The aromatic primary amine developing agent as the color developing agent is a compound has a primary amino group on the aromatic ring with an ability to develop the exposed silver halide, and further a precursor capable of forming such a compound may be added.

Typical examples of the above color developing agent are p-phenylenediamine type compounds, and preferable examples include the following:

4-amino-N,N-diethylaniline, 3-methyl-4-amino-N,N-diethylaniline, 4-amino-N-ethyl-N-β-hydroxyethylaniline, 3-methyl-4-amino-N-β-hydroxyethylaniline, 3-methyl-4-amino-N-ethyl-N-β-methoxyethylaniline, 3-methyl-4-amino-N-ethyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]-ethyl-3-methyl-4-aminoaniline, N-ethyl-N-β-(β-methoxyethoxy)ethyl-3-methyl-4-aminoaniline, or salts thereof such as sulfates, hydrochlorides, sulfites, p-toluensulfonates, etc.

Further, those disclosed in, for example, Japanese Unexamined Patent Publications Nos. 64932/1973, 131526/1975 and 95849/1976 and Bent et al, Journal of the American Chemical Society, vol. 73, pp. 3100–3125, 1951 may also be included as typical examples.

The amount of these aromatic primary amino compounds used may be determined depending on the activity of the developing solution set, and it is preferred to increase the amount used in order to increase the acivity. The amount used may be within the range of from 0.0002 mole/liter to 0.7 mole/liter. Also, depending on the purpose, two or more compounds may be suitably selected and used. For example, any derived combination can freely be used such as the combinations of 3-methyl4-amino-N,N-diethylaniline with 3-methyl-4-amino-N-ethyl-N-β-methanesulfonamidoethylaniline, 3-methyl-4-amino-N-ethyl-N-β-methanesulfonamidoethylaniline with 3-methyl-4-amino-N-ethyl-N-β-hydroxyethylaniline, etc.

The color developing solution to be used in this invention can further incorporate various components conventionally added, for example, alkali agents such as sodium hydroxide, sodium carbonate, etc., alkali metal sulfites, alkali metal hydrogen sulfites, alkali metal thiocyanates, alkali metal halides, benzyl alcohol, water softeners, thickeners and development promoters, as desired.

Other additives than those as mentioned above which can be added to the above developing solution may include, for example, compounds for rapid processing solutions such as bromides (e.g. potassium bromide and ammonium bromide), alkali iodides, nitrobenzoimidazole, mercaptobenzoimidazole, 5-methyl-benzotriazole, 1-phenyl-5-mercaptotetrazole, etc., stain preventives, sludge preventives, preservatives, overlaying effect promoting agents, chelating agents, etc.

As the bleaching agent to be used in the bleaching solution or the bleach-fixing solution in the bleaching step, there have been generally known aminopolycarboxylic acids or organic acids such as oxalic acid, citric acid, etc. having metal ions such as of iron, cobalt, copper, etc. coordinated. Typical examples of the above aminopolycarboxyic acids may include the following:

Ethylenediaminetetraacetic acid, Diethylenetriaminepentaacetic acid, Propylenediaminetetraacetic acid, Nitrilotriacetic acid, Iminodiacetic acid, Ethyletherdiaminetetraacetic acid, Ethylediaminetetrapropionic acid, Disodium ethylenediaminetetraacetate, Pentasodium diethylenetriaminepentaacetate, and Sodium nitrilotriacetate.

The bleaching solution may also contain various additives together with the above bleaching agent. Also, when employing a bleach-fixing solution in the bleaching step, a solution with a composition containing a silver halide fixing agent in addition to the above bleaching agent is applied. Further, the bleach-fixing solution may also contain a halide compound such as potassium bromide. And, similarly as in the case of the above bleaching solution, other various additives such as pH buffering agents, brightening agents, defoaming agents, surfactants, preservatives, chelating agents, stabilizers, organic solvents, etc. may also be added and contained.

The silver halide fixing agent may include, for example, sodium thiosulfate, ammonium thiosulfate, potassium thiocyanate, sodium thiocyanate, or compounds capable of forming water-soluble silver salts through the reaction with silver halides conventionally used in fixing processing, such as thiourea, thioether, etc.

The processing temperature in the various processing steps such as color developing, bleach-fixing (or bleaching and fixing), further water washing, stabilizing, drying, etc. optionally conducted may preferably be 30° C. or higher from the standpoint of rapid processing.

According to the light-sensitive silver halide color photographic material of this invention, in a light-sensitive silver halide color photographic material having a blue-sensitive silver halide emulsion layer, a green-sensitive silver halide emulsion layer and a red-sensitive silver halide emulsion layer on a support, the content of silver bromide in the silver halides of said green-sensitive silver halide emulsion layer and red-sensitive silver halide emulsion layer is 5 to 65 mole % and said green-sensitive silver halide emulsion layer contains the pyrazolotriazole type magenta coupler of this invention, and therefore rapid developing processing is possible with improvement of processing stability in said rapid developing processing, and yet saving of silver is possible, simultaneously with inhibition of generation of fog, and moreover color image with good light resistance can be obtained.

This invention is described in more detail by referring to the following Examples, but the embodiments of this invention are not limited thereto.

EXAMPLE 1

Onto a paper support laminated on both surfaces with polyethylene, the following respective layers were successively coated to prepare Samples Nos. 1 to 3 of light-sensitive silver halide color photographic materials.

Layer 1 . . . a layer containing 1.2 g/m$^2$ of gelatin, 0.32 g/m$^2$ (calculated on silver, hereinafter the same) of a blue-sensitive silver chlorobromide emulsion (silver bromide content and mean grain size are shown in Table 1) and 0.80 g of a yellow coupler (Y-1) dissolved in 0.50 g/m$^2$ of dioctyl phthalate.

Layer 2 . . . an intermediate layer comprising 0.70 g/m$^2$ of gelatin.

Layer 3 . . . a layer containing 1.25 g/m$^2$ of gelatin, 0.15 g/m$^2$ of a green-sensitive silver chlorobromide emulsion (silver bromide content and mean grain size are shown in Table 1) and 0.52 g/m$^2$ of the above exemplary compound (11) of the pyrazolotriazole type magenta coupler dissolved in 0.30 g/m$^2$ of dioctyl phthalate.

Layer 4 . . . an intermediate layer comprising 1.20 g/m$^2$ of gelatin.

Layer 5 . . . a layer containing 1.20 g/m$^2$ of gelatin, 0.30 g/m$^2$ of a red-sensitive silver chlorobromide emulsion (silver bromide content and mean grain size are shown in Table 1) and 0.45 g/m$^2$ of the a cyan coupler (C-1) as shown below dissolved in 0.20 g.m/2 of dioctyl phthalate.

Layer 6 . . . a layer containing 1.00 g/m$^2$ of gelatin and 0.30 g/m$^2$ of a UV-ray absorber (UV-1) as shown below dissolved in 0.20 g/m$^2$ of dioctyl phthalate.

Layer 7 . . . a layer containing 0.50 g/m$^2$ of gelatin.

Also, as the film hardening agent, 2,4-dichloro-6-hydroxy-S-triazine sodium was added into the layers 2, 4 and 7, respectively, to a content of 0.017 g per 1 g of gelatin.

TABLE 1

| | R *1 | | R *2 | | R *3 | |
|---|---|---|---|---|---|---|
| Sample No. | mean grain size (μm) | AgBr content (mole %) | mean grain size (μm) | AgBr content (mole %) | mean grain size (μm) | AgBr content (mole %) |
| 1 (This invention) | 0.5 | 80 | 0.4 | 60 | 0.4 | 60 |
| 2 (This invention) | 0.5 | 80 | 0.3 | 30 | 0.3 | 30 |
| 3 (Comparative | 0.5 | 80 | 0.4 | 80 | 0.4 | 80 |

*1: a blue-sensitive silver halide emulsion, hereinafter the same.
*2: a green-sensitive silver halide emulsion, hereinafter the same.
*3: a red-sensitive silver halide emulsion, hereinafter the same.

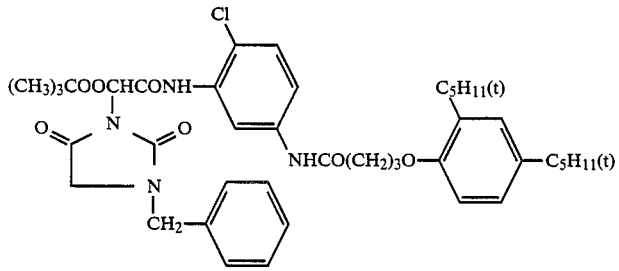

(Y-1)

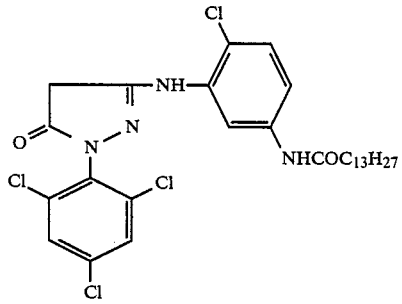

(MM-1)

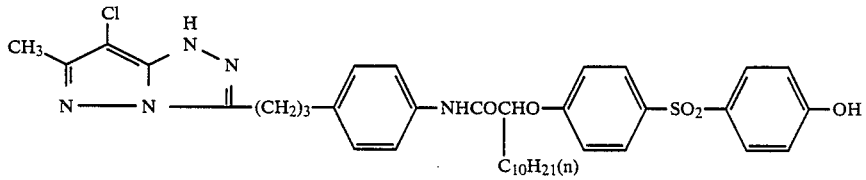

(MM-2)

-continued

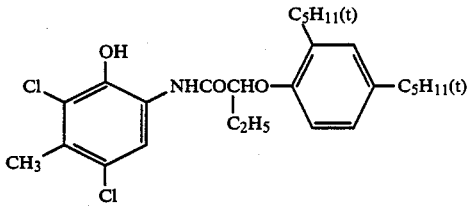

(C-1)

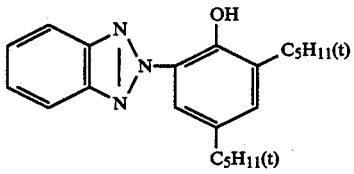

(UV-1)

Next, for the above Samples Nos. 1 to 3, the magenta coupler in the green-sensitive silver chlorobromide emulsion was replaced with the above (MM-1) (silver amount of 0.62 g/m$^2$) and also the silver amount in the green-sensitive silver chlorobromide emulsion was changed to 0.22 g/m$^2$, otherwise following the same procedure, Samples Nos. 4 to 6 corresponding to Samples Nos. 1 to 3 were prepared. Here, the above (MM-1) is outside of the scope of this invention and thus Samples Nos. 3 to 6 are Comparative Samples.

After exposure of the above light-sensitive materials of Samples Nos. 1 to 6 through an optical wedge, they were processed according to the following steps.

| Processing steps (38° C.) | |
|---|---|
| Color developing | 3 min. |
| Bleach-fixing | 1 min. 30 sec. |
| Water washing | 1 min. |
| Drying | 60 to 80° C., 2 min. |

The respective processing liquors had the following compositions.

| [Color developing solution] | |
|---|---|
| Pure water | 800 ml |
| Benzyl alcohol | 15 ml |
| Hydroxyamine sulfate | 2.0 g |
| Potassium bromide | 1.5 g |
| Sodium chloride | 1.0 g |
| Potassium sulfite | 2.0 g |
| Triethanolamine | 2.0 g |
| N—ethyl-N—β—methanesulfonamido-ethyl-3-methyl-4-aminoaniline sulfate | 4.5 g |
| 1-Hydroxyethylidene-1,1-diphosphonic acid (60% aqueous solution) | 1.5 ml |
| Potassium carbonate | 32 g |
| Whitex BB (50% aqueous solution) (brightening agent, produced by Sumitomo Kagaku Kogyo K. K.) | 2 ml |

(made up to one liter with addition of pure water and adjusted to pH=10.1 with 20% potassium hydroxide or 10% dil. sulfuric acid).

| [Bleach-fixing solution] | |
|---|---|
| Pure water | 550 ml |
| Iron (III) ammonium ethylene-diaminetetraacetate | 65 g |
| Ammonium thiosulfate | 85 g |

-continued

| [Bleach-fixing solution] | |
|---|---|
| Sodium hydrogen sulfite | 10 g |
| Sodium metabisulfite | 2 g |
| Disodium ethylenediamine-tetraacetate | 20 g |
| Sodium bromide | 10 g |

(made up to one liter with addition of pure water and adjusted to pH=7.0 with ammonia water or dil. sulfuric acid).

Separately, by use of color developing solutions which are different from the above color developing solution only in that potassium bromide was changed to 0.5, 1.0, 2.0 and 2.5 g, the same Samples Nos. 1 to 6as above were subjected to developing processing, respectively.

For the respective samples obtained, sensitometry was performed in a conventional manner. The gamma values at respective potassium bromide concentrations are shown in Table 2.

TABLE 2

| Sample No. | | Potassium bromide (g/l) 0.5 γ *4 | 1.0 γ | 1.5 γ | 2.0 γ | 2.5 γ | Fluctuation width *5 Δγ |
|---|---|---|---|---|---|---|---|
| 1 (This invention) | R | 2.99 | 3.00 | 3.01 | 2.97 | 2.94 | 0.09 |
| | O | 3.33 | 3.39 | 3.43 | 3.55 | 3.69 | 0.36 |
| | P | 3.34 | 3.48 | 3.54 | 3.68 | 3.80 | 0.46 |
| 2 (This invention) | R | 3.02 | 3.04 | 3.06 | 3.03 | 3.00 | 0.10 |
| | O | 3.27 | 3.35 | 3.38 | 3.49 | 3.65 | 0.37 |
| | P | 3.31 | 3.47 | 3.53 | 3.65 | 3.78 | 0.47 |
| 3 (Comparative) | R | 2.87 | 2.95 | 3.01 | 2.93 | 2.88 | 0.27 |
| | O | 2.95 | 3.14 | 3.36 | 3.51 | 3.82 | 0.87 |
| | P | 3.12 | 3.23 | 3.48 | 3.75 | 3.94 | 0.82 |
| 4 (Comparative) | R | 2.98 | 3.00 | 3.01 | 2.99 | 2.95 | 0.09 |
| | O | 3.28 | 3.31 | 3.32 | 3.53 | 3.76 | 0.49 |
| | P | 3.30 | 3.48 | 3.51 | 3.67 | 3.81 | 0.51 |
| 5 (Comparative) | R | 3.00 | 3.01 | 3.05 | 3.03 | 2.98 | 0.12 |
| | O | 3.23 | 3.28 | 3.32 | 3.53 | 3.75 | 0.52 |
| | P | 3.31 | 3.43 | 3.49 | 3.62 | 3.82 | 0.51 |
| 6 (Comparative) | R | 2.92 | 2.99 | 2.98 | 2.89 | 2.77 | 0.27 |
| | O | 2.93 | 3.07 | 3.21 | 3.51 | 3.85 | 0.92 |
| | P | 3.08 | 3.15 | 3.49 | 3.69 | 3.93 | 0.83 |

TABLE 2-continued

| Sample No. | Potassium bromide (g/l) 0.5 γ *4 | 1.0 γ | 1.5 γ | 2.0 γ | 2.5 γ | Fluctuation width *5 Δγ |
|---|---|---|---|---|---|---|
| tive) | | | | | | |

*4: a slope of sensitometry at density of 0.8 to 1.8.
*5: fluctuation width: $\Delta\gamma = \Delta\gamma_1 + \Delta\gamma_2$, $\Delta\gamma_1 = |\gamma(1.5) - \gamma(0.5)|$, $\Delta\gamma_2 = |\gamma(1.5) - \gamma(2.5)|$ Here, for example, γ(1.5) means a potassium bromide quantity of 1.5 g/l.

As is apparent from comparison between Samples Nos. 3 and 6, the effect of improvement of processing stability is little even by use of the combination with the pyrazolotriazole type magenta coupler of this invention, if silver halide emulsions outside the scope of this invention are used in the blue-sensitive silver halide emulsion layer, the green-sensitive silver halide emulsion layer and the red-sensitive silver halide emulsion layer. In contrast, as is apparent from the comparison between Samples Nos. 1 and 4 and between Samples Nos. 2 and 5, by use of the combination of the silver halide emulsions within the scope of this invention and the pyrazolotriazole type magenta coupler of this invention, it can be appreciated that the processing stability of the light-sensitive silver halide emulsion layers, particularly the green-sensitive silver halide emulsion layer, can be markedly improved.

EXAMPLE 2

By use of Samples Nos. 1 to 6, fog of the green-sensitive silver halide emulsion layer was examined with the use of the respective processing solutions in Example 1 (the potassium bromide concentration in the color developing solution was set at 1.0 g/liter) except that the color developing time was changed to 3 min. 30 sec. The results are shown in Table 3.

TABLE 3

| Sample No. | Fog |
|---|---|
| 1 (This invention) | 0.03 |
| 2 (This invention) | 0.03 |
| 3 (Comparative) | 0.06 |
| 4 (Comparative) | 0.05 |
| 5 (Comparative) | 0.05 |
| 6 (Comparative) | 0.04 |

As is apparent from the results in Table 3, generation of fog can be suppressed in Samples Nos. 1 and 2 of this invention due to the use of a pyrazolotriazole type magenta coupler as the coupler.

EXAMPLE 3

By use of Sample No. 1, rapid processing performance was tested. That is, by use of the respective processing solutions of Example 1 (the potassium bromide concentration in the color developing solution was set at 1.0 g/liter), sensitivity (S), gamma (Y) and maximum density (Dm) were examined when the color developing time was made 2 min., 2 min. 30 sec. and 3 min. The results are shown in Table 4.

TABLE 4

| Color developing time | | S* | γ | Dm |
|---|---|---|---|---|
| 2 min. | R | 98 | 2.95 | 2.41 |
| | O | 99 | 3.11 | 2.52 |
| | P | 99 | 3.05 | 2.60 |
| 2 min. 30 sec. | R | 99 | 2.98 | 2.50 |
| | O | 100 | 3.20 | 2.53 |
| | P | 100 | 3.07 | 2.64 |
| 3 min. | R | 100 | 3.00 | 2.50 |
| | O | 100 | 3.21 | 2.55 |
| | P | 100 | 3.10 | 2.65 |

*: relative sensitivity to the sensitivity of 100 when developed for 3 minutes.

As is apparent from the results in Table 4, it can be appreciated that Sample No. 1 of this invention gives satisfactory photographic performance even at a color developing time of 2 minutes, thus being excellent in rapid processing performance.

EXAMPLE 4

When Example 3 was repeated except that Sample No. 4 was used in place of Sample No. 1 in Example 1, the same result as in the above Sample No. 1 was obtained with respect to Dm of the green-sensitive silver halide emulsion layer. As can be seen also from this fact, according to this invention, high Dm can be obtained in spite of the low level of the silver employed.

EXAMPLE 5

In Sample No. 1 in Example 1, only the exemplary compound (11) was changed to the above MM-2 to prepare Sample No. 7, which was then irradiated after development by a xenon fadometer for 5 days, and light resistance of the magenta image was compared with Sample No. 1. The results are shown in Table 5.

TABLE 5

| Sample No. | Light resistance* (%) | Remark |
|---|---|---|
| 1 | 88 | This invention |
| 7 | 47 | Comparative |

*light resistance: residual dye ratio (%) after light resistance test at initial density of 1.0

As is apparent from Table 5, it can be appreciated that Sample No. 1 of this invention is very good in light resistance as compared with Sample No. 7 containing a pyrazolotriazole type magenta coupler outside the scope of this invention.

We claim:

1. A light-sensitive silver halide color photographic material having photographic constituent layers including a blue-sensitive silver halide emulsion layer, a green-sensitive silver halide emulsion layer and a red-sensitive silver halide emulsion layer on a support, wherein the content of silver bromide of the silver halides in said green-sensitive silver halide emulsion layer and red-sensitive silver halide emulsion layer is 5 to 65 mole %, and said green-sensitive silver halide emulsion layer contains at least one of the compounds represented by the formula [I] shown below:

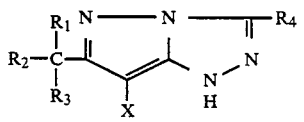

wherein X represents a halogen atom or a monovalent organic group eliminable through coupling reaction with an oxidized product of a developing agent; $R_1$ to $R_3$, which may be either identical or different, each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residue, a bridged hydrocarbon compound residue, an alkoxy group, an aryloxy group, a heterocycloxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclic thio group, with proviso that at least two of $R_1$ to $R_3$ are not hydrogen atoms; $R_4$ represents a hydrogen atom, an alkyl group, an aryl group, a heterocyclic group, an acylamino group, an alkylamino group, an anilino group, an alkoxycarbonyl group or an alkylthio group.

2. The light-sensitive silver halide color photographic material according to claim 1, wherein the content of said silver bromide of the silver halides in the green-sensitive silver halide emulsion layer is 30 to 55 mole %.

3. The light-sensitive silver halide color photographic material according to claim 2, wherein the content of said silver bromide of the silver halides in the red-sensitive silver halide emulsion layer is 30 to 55 mole %.

4. The light-sensitive silver halide color photographic material according to claim 2, wherein the mean grain size of said silver halide in the blue-sensitive silver halide emulsion layer is 0.20 to 0.55 μm.

5. The light-sensitive silver halide color photographic material according to claim 2, wherein the mean grain size of said silver halide in the green-sensitive silver halide emulsion layer is 0.25 to 0.80 μm.

6. The light-sensitive silver halide color photographic material according to claim 1, wherein the mean grain size of said silver halide in the green-sensitive silver halide emulsion layer is 0.25 to 0.80 μm.

7. The light-sensitive silver halide color photographic material according to claim 6, wherein the mean grain size of said silver halide in the red-sensitive silver halide emulsion layer is 0.25 to 0.80 μm.

8. The light-sensitive silver halide color photographic material according to claim 1, wherein said green-sensitive silver halide emulsion layer contains at least one of the compounds represented by the formula [I] in an amount of from $2\times10^{-3}$ to $5\times10^{-1}$ mole per mole of silver contained in the green-sensitive silver halide emulsion layer.

9. The light-sensitive silver halide color photographic material according to claim 1, wherein said compound of formula I is

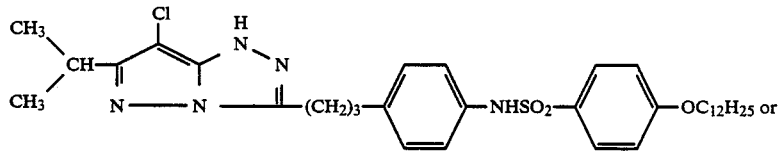

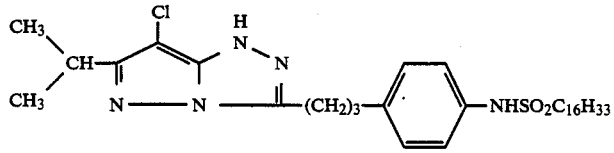

10. The light-sensitive silver halide color photographic material according to claim 1, wherein said compound of formula I is

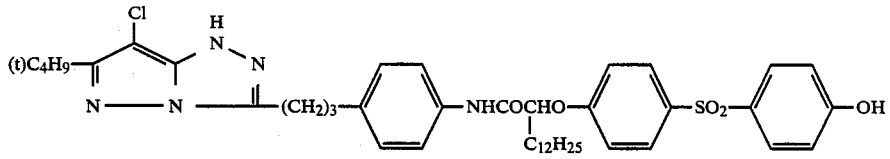

11. An image forming process which comprises subjecting to imagewise exposure and developing a light-sensitive silver halide color photographic material having photographic constituent layers including a blue-sensitive silver halide emulsion layer, a green-sensitive silver halide emulsion layer and a red-sensitive silver halide emulsion layer on a support in a bleach-fixing bath containing aminopolycarboxylic acid, wherein the content of silver bromide of the silver halides in said green-sensitive silver halide emulsion layer and red-sensitive silver halide emulsion layer is 5 to 65 mole %, and said green-sensitive silver halide emulsion layer contains at least one of the compounds represented by the formula [I] shown below:

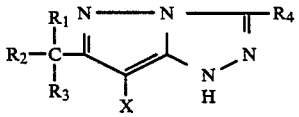

wherein X represents a halogen atom or a monovalent organic group eliminable through coupling reaction with an oxidized product of a developing agent; $R_1$ to $R_3$, which may be either identical or different, each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residue, a bridged hydrocarbon compound residue, an alkoxy group, an aryloxy group, a heterocycloxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclic thio group, with proviso that at least two of $R_1$ to $R_3$ are not hydrogen atoms; $R_4$ represents a hydrogen atom, an alkyl group, an aryl group, a heterocyclic group, an acylamino group, an alkylamino group, an anilino group, an alkoxycarbonyl group or an alkylthio group.

* * * * *